US007280777B2

(12) United States Patent
Takahashi et al.

(10) Patent No.: US 7,280,777 B2
(45) Date of Patent: Oct. 9, 2007

(54) IMAGE FORMING APPARATUS WITH FIXING CONTROL BASED ON RECORDING MATERIAL TYPE

(75) Inventors: Keita Takahashi, Abiko (JP); Akihito Mori, Toride (JP); Nobuo Sekiguchi, Moriya (JP); Takashi Nagaya, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 174 days.

(21) Appl. No.: 11/085,549

(22) Filed: Mar. 22, 2005

(65) Prior Publication Data

US 2005/0220467 A1 Oct. 6, 2005

(30) Foreign Application Priority Data

Mar. 31, 2004 (JP) ..... 2004-105244

(51) Int. Cl.
*G03G 15/20* (2006.01)

(52) U.S. Cl. ..... 399/45; 399/69

(58) Field of Classification Search ..... 399/45, 399/67, 69, 329
See application file for complete search history.

(56) References Cited

U.S. PATENT DOCUMENTS

| | | | | |
|---|---|---|---|---|
| 4,796,035 | A | 1/1989 | Kawasaki et al. | 347/262 |
| 5,666,595 | A | 9/1997 | Sameshima et al. | 399/110 |
| 6,006,052 | A * | 12/1999 | Kamimura et al. | 399/69 |
| 6,047,158 | A * | 4/2000 | Morigami et al. | 399/328 |
| 6,249,657 | B1 | 6/2001 | Kagawa | 399/67 |
| 6,311,039 | B1 | 10/2001 | Funamizu et al. | 399/394 |
| 6,393,232 | B1 | 5/2002 | Osari et al. | 399/82 |
| 6,397,035 | B2 | 5/2002 | Kataoka et al. | 399/388 |
| 6,650,863 | B2 * | 11/2003 | Fuma | 399/329 |
| 2003/0230561 | A1 * | 12/2003 | Kagawa et al. | 219/216 |
| 2004/0247333 | A1 | 12/2004 | Takahashi | 399/68 |
| 2004/0258427 | A1 | 12/2004 | Takahashi | 399/69 |
| 2005/0025543 | A1 | 2/2005 | Watanabe et al. | 399/391 |

FOREIGN PATENT DOCUMENTS

| | | | |
|---|---|---|---|
| JP | 61-132972 | | 6/1986 |
| JP | 01195483 | A * | 8/1989 |
| JP | 1-279278 | | 11/1989 |
| JP | 3-288171 | | 12/1991 |
| JP | 11-194647 | | 7/1999 |
| JP | 2000-235319 | | 8/2000 |
| JP | 2004-198823 | | 7/2004 |

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An image forming apparatus has an image forming device for forming an image on a recording material; a heating member heating the image formed on the recording material in a nip portion; an endless belt conveying the recording material toward the nip portion formed between itself and the heating member; a contacting and separating device for bringing the heating member and the belt into the contact with each other and for separating the heating member and the belt from each other; and a detection device for detecting the temperature of the belt. If the detected temperature of the belt reaches a predetermined temperature, an image formation job is interrupted, and the heating member and the belt are separated.

9 Claims, 7 Drawing Sheets

IMAGE FORMING APPARATUS WITH FIXING CONTROL BASED ON RECORDING MATERIAL TYPE

BACKGROUND OF THE INVENTION

1. Field of the Invention

The present invention relates to an image forming apparatus forming an image on a recording material, for example an image forming apparatus such as a copier, printer or fax machine.

2. Related Background Art

Most fixing apparatuses which have been employed in electrophotographic apparatuses are hot-press type fixing apparatuses in which a toner carried on a recording material is heated and pressured to be melted and fixed.

They are classified broadly into two types: one is a roller type fixing apparatus (roller fixing) in which a pair of rollers are abutted against each other in a face-to-face manner, heating sources are placed in one of the rollers or both rollers, and an abutment portion thereof is made to nip and convey a recording material to execute fixing process, and the other is so called a belt type fixing apparatus (belt fixing) comprised of a roller as one part and a belt as the other part.

That is, it has as a basic structure a roller pair of a fixing roller (heat roller) thermally adjusted to have a predetermined fixing temperature and a pressure roller abutted against the fixing roller, wherein the roller pair is rotated, a recording material having an unfixed toner image formed thereon is introduced into a fixing nip portion being an abutment portion of the roller pair, and nipped and conveyed to hot pressing-fix the unfixed toner image on the recording material by means of the heat of the fixing roller and the pressure of the fixing nip portion.

The amount of heat given to the recording material bearing the unfixed toner image depends on temperatures of the fixing roller and the pressure roller, and a time period over which the recording material passes through the fixing nip portion, i.e. a fixing nip width and a travel speed of the recording material. The fixing nip width refers to a length of the fixing nip portion along which the recording material travels.

For a fixing apparatus to be mounted on an electrophotographic apparatus having a higher process speed, a fixing apparatus having a larger fixing nip width is required in relation to the amount of heat described above. For increasing the fixing nip width in the roller fixing described above, the diameter of the roller should be increased, and if the diameter of the roller is increased, there arises a problem such that the heat capacity of the roller increases to lengthen the heat-up time (warm-up time) of the roller.

Thus, as a fixing apparatus configuration capable of securing a large fixing nip width without increasing the diameter of the roller, a belt type fixing apparatus is proposed in Japanese Patent Application Laid-Open No. S61-132972.

In such a belt type fixing apparatus, a heat-resistant and flexible endless belt stretched between a plurality of belt stretching members is abutted against a fixing roller being a rotating member for heating to form a fixing nip portion, and the fixing nip portion is made to nip and convey a recording material bearing an unfixed toner image, whereby the unfixed toner image is hot press-fixed on the recording material by means of the heat of the fixing roller and the pressure of the fixing nip portion. This belt type fixing apparatus allows the fixing nip width to be easily set to a larger width by adjusting a width of the endless belt facing the fixing roller. The fixing nip width can be secured independently of the diameter of the fixing roller, and therefore the diameter and the heat capacity of the fixing roller can be reduced, thus making it possible to shorten the start-up time.

In the case of the belt type fixing apparatus, so called a fixing nip width is large from a configuration viewpoint, a time period over which the fixing roller and the belt contact each other is therefore lengthened, and thus the temperature of the belt tends to be elevated. The heat capacity of the belt is small compared to the pressure roller, and therefore the temperature tends to be elevated in a short time period. Thus, the following problems arise.

(1) The amount of heat given to the recording material increases, and therefore the amount of water vapor emerging from the recording material containing water increases. The water vapor is blocked by a toner layer fixed on the front surface of the recording material, thus can hardly escape to the front surface of the recording material, and concentrates on the rear surface of the recording material. Thus, a water vapor layer with a pressure high enough to separate the recording material and the pressure belt tends to be formed between the rear surface of the recording material and the belt in the fixing nip portion, and this layer drastically reduces a frictional force at the interface between the rear surface of the recording material and the belt. As a result, there are cases where a recording material conveying power with rotation of the belt is considerably reduced, leading to occurrence of an image defect and a conveyance defect.

(2) Some users use, as the recording material, resin coated sheets (hereinafter referred to as coated sheets) of which the glossiness of the front surface or both front and rear surfaces is increased by coating the front surface or both front and rear surfaces with an acryl resin, polyolefin resin or the like. There are cases where when the fixing apparatus is made to pass with a toner placed on the coated sheet, an image defect called a blister in which the recording material is partially deformed like a blister occurs. It can be considered that this is caused due to the fact that water in the interior of the coated sheet is evaporated by heating by the fixing apparatus to increase the volume, but due to a coat layer on the surface of the coated sheet, vaporized water vapor is not uniformly dissipated to outside the coated sheet, but collectively discharged to outside the coated sheet from a portion in which the coat layer is thinned or absent, and therefore the coat layer is ruptured.

For preventing occurrence of such a phenomenon, a configuration in which the belt and the fixing roller are separated during standby is proposed in Japanese Patent Application Laid-Open No. H11-194647.

However, the above conventional technique has the following problem.

In an image formation job for continuously forming images on a plurality of recording materials, the belt contacts the fixing roller even during a time period over which no recording material exists in the fixing nip (so called sheet interval), and heat of the fixing roller is therefore transferred to the belt, and the temperature of the belt becomes equivalent to the temperature of the fixing roller. Thus, fixing process can be satisfactorily executed for recording materials in the initial stage of the image formation job, but there are cases where the above image defect and conveyance defect resulting from elevation of the temperature of the belt occur for recording materials in the middle or late stage of the image formation job.

SUMMARY OF THE INVENTION

An object of the present invention is to provide an image forming apparatus which can inhibit occurrence of an image defect and a conveyance defect resulting from elevation of the temperature of a belt.

Another object of the present invention is to provide an image forming apparatus which includes: an image forming device for forming an image on a recording material; a heating member heating the image formed on the recording material in a nip portion; an endless belt conveying the recording material toward the nip portion formed between itself and the heating member; a contacting and separating device for bringing said heating member and said belt into the contact with each other and for separating said heating member and said belt from each other; and a detection device for detecting the temperature of the belt, wherein if the detected temperature of the belt reaches a predetermined temperature, an image formation job is interrupted, and the heating member and the belt are separated.

Further objects of the present invention will be apparent from the following detailed description with reference to the attached drawings.

DESCRIPTION OF THE PREFERRED EMBODIMENTS

Embodiment 1

(1) Example of Image Forming Apparatus

Figure 1:
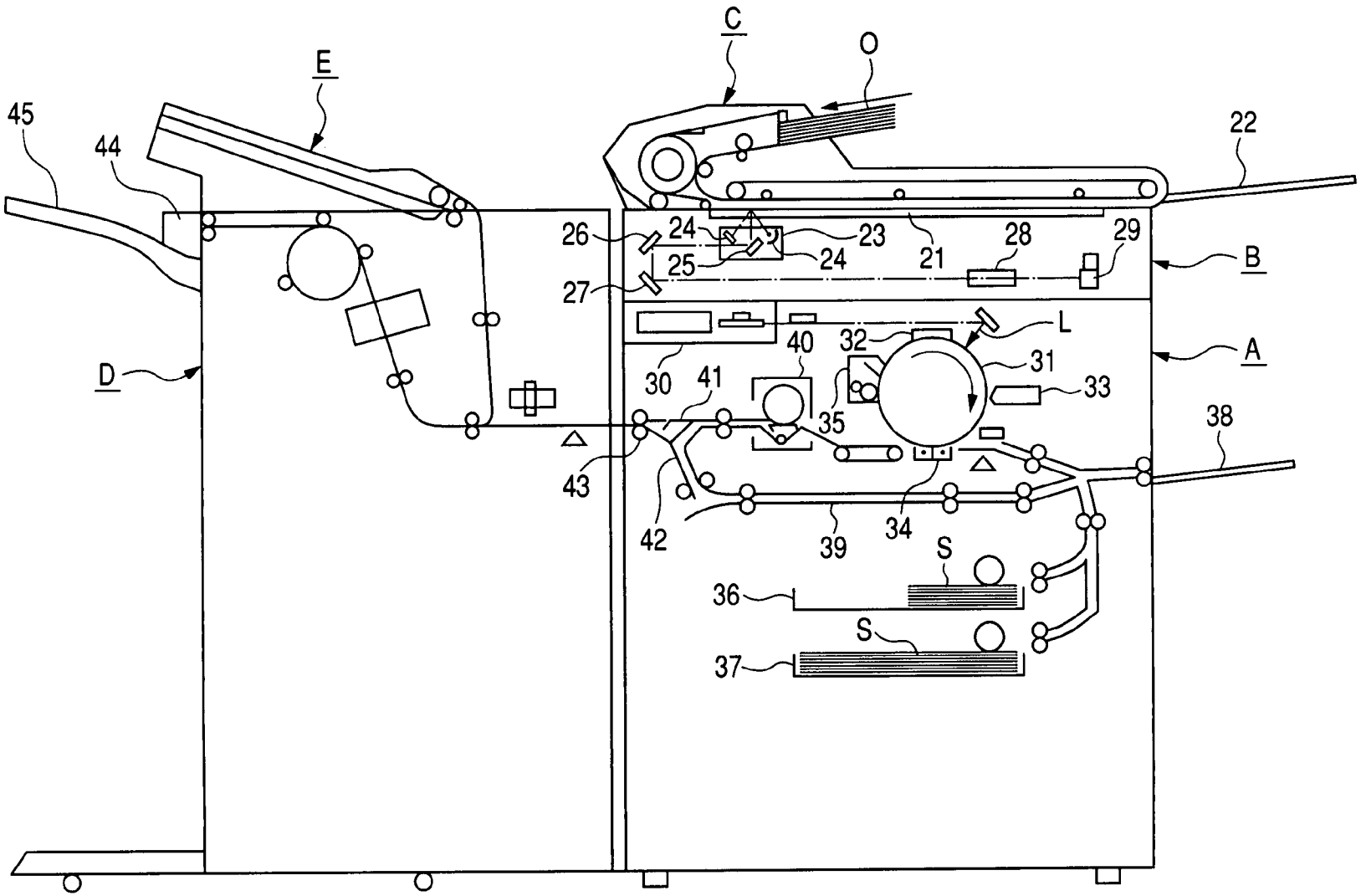
FIG. 1 is a schematic illustration of an embodiment of an image forming apparatus.

FIG. 1 is a model diagram of the general configuration of an image forming apparatus in this embodiment. The image forming apparatus comprises a laser beam scan exposure type printer portion A using a transfer electrophotographic process, an image reader portion B, an original feeding apparatus C and a finisher D.

The original feeding apparatus C feeds a set original O sequentially on a sheet-by-sheet basis starting with a first page through a curved pass onto a platen glass 21 of the image reader portion B with the image bearing surface faced downward, conveys the original O from the left to the right on the platen glass 21, and discharges it to a sheet discharging tray 22. At this time, a reader scanner unit 23 of the image reader portion B is held at a predetermined fixed position below the platen glass 21, and photoelectrically reads sequentially in a flowing manner images on the downward faced surface of the original passing on the platen glass 21. That is, the reader scanner unit 23 illuminates the downward faced surface of the original passing on the platen glass 21 with light from a lamp 24 through the platen glass 21, guides the illuminating light reflected from the surface of the original through mirrors 25, 26 and 27 and a lens 28 to an image sensor 29 to form an image, and photoelectrically reads the image of the original. Photoelectrical reading of the image of the original by the image sensor 29 can also be carried out by an optical system movement system in which the original is conveyed onto the platen glass 21 by the original feeding apparatus C and temporarily stopped, and the reader scanner unit 24 and the mirrors 26 and 27 are moved from the left to the right along the undersurface of the platen glass 21.

An electric signal of the image of the original read by the image sensor 29 is subjected to image processing and sent to an exposure controlling portion (laser scanner) 30. The exposure controlling portion 30 outputs laser light L modulated in response to the electric signal of the image of the original subjected to image processing.

Reference numeral 31 denotes a drum type electrophotographic photosensitive member (hereinafter referred to as photosensitive drum) as an image bearing member, which is rotationally driven at a predetermined speed in the clockwise direction shown by the arrow. The photosensitive drum 1 is subjected to a uniform charging treatment at a predetermined polarity/potential in a rotational state by a charging device 32, and then has the charging treatment surface subjected to scan exposure by laser light L output from the exposure controlling portion 30. Thus, an electrostatic latent image corresponding to a scan exposure pattern is formed on the surface of the photosensitive drum 31. The electrostatic latent image is developed as a toner image by a developing device 33.

In a transferring portion 34, the toner image formed on the photosensitive drum 31 is transferred to a recording material S (hereinafter referred to as a sheet) fed to the transferring portion 34 from any one of a first or second sheet feeding cassette 36 or 37, a manual sheet feeding portion 38 and a double side conveying pass 39.

The sheet S, to which the toner image is transferred in the transferring portion 34, is separated from the surface of the photosensitive drum 31 and introduced into a fixing apparatus 40 as an image heating apparatus, and has the toner image fixed thereon.

The surface of the photosensitive drum 1 after separation of the sheet gas residual deposited materials such as a post-transferring residual toner and a sheet powder removed therefrom by a cleaning device 35 and is thus cleaned, and is repeatedly used for image formation.

The sheet which has passed through the fixing apparatus 40 is guided to a pass 42 on a temporary basis by a flapper 41, and after the rear end of the sheet is leaves the flapper 41, the sheet switched back and guided to a discharging roller 43 by the flapper 41 in he case of the single side image formation mode. Thus, the sheet is discharged from the printer portion A to the finisher D side by the discharging roller 43 with the image bearing surface faced downward (face down).

In the case of a mode in which a hard sheet such as an OHP sheet is fed from the manual sheet feeding portion 38 to form an image thereon, the sheet is not guided to the pass 42, i.e. the sheet leaving the fixing apparatus 40 is made to pass above the flapper 41, and discharged from the discharging roller 43 with the image bearing surface faced upward (face up).

In the case of the double side image mode in which images are formed on both surfaces of the sheet, the sheet having an image formed on the first surface, which has exited from the fixing apparatus 40, is made to pass through the upper side of the flapper 41 and guided to the discharging roller 43, and just after the rear end of the sheet leaves the flapper 41, the sheet is switched back, and guided from the pass 42 to the double side conveying pass 39 by the flapper 41. The sheet is fed from the double side conveying pass 39 to the transferring portion 34 again with the front surface and the rear surface reversed to transfer the toner image to a second surface, and the sheet is again introduced into the fixing apparatus 40 to fix the toner image to the second surface. Thereafter, the sheet having images formed on both surfaces is discharged from the printer portion A to the finisher D side by the discharging roller 43 through a sheet discharging channel in the same manner as in the single side image formation mode described above.

The finisher D performs treatments such as a shift treatment, a binding treatment and punching. The finisher D is provided thereon with an inserter E, which feeds a cover sheet, an inserting sheet and the like to the finisher D. An alignment plate 44 moves at an angle perpendicular to a conveyance direction to discharge the sheet to the rearward or frontward on the tray if the recording material is output in a shifted manner as in shift sort.

(2) Operation Panel

Figure 2:
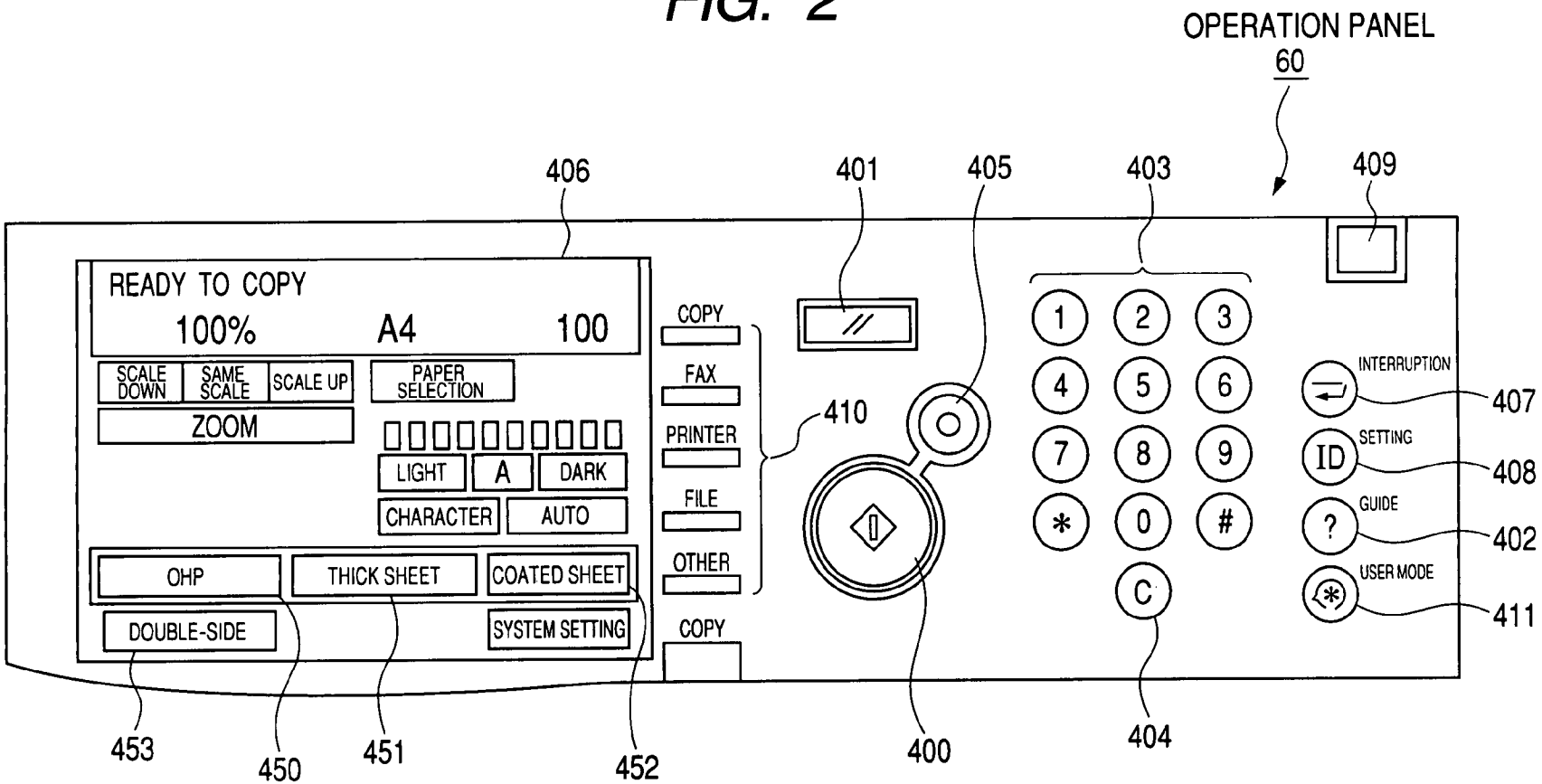
FIG. 2 is an outline view of an operation panel.

An operation panel (operation portion) will now be described. FIG. 2 shows the configuration of an operation panel 60 provided in the image forming apparatus. Reference numeral 400 denotes a copy start key for indicating the start of copy. Reference numeral 401 denotes a reset key for returning the mode to the standard mode. Reference numeral 402 denotes a guidance key which is pressed down when a guidance function is used. Reference numeral 403 denotes a ten key for inputting a value such as a set number of sheets. Reference numeral 404 is a clear key for clearing a value. Reference numeral 405 denotes a stop key for stopping copy during continuous copy. Reference numeral 406 denotes a liquid crystal display portion displaying settings of various kinds of modes such as a staple mode, bookbinding mode or double side print setting and states of the printer, and a touch panel. Reference numeral 407 denotes an interruption key for interrupting continuous copy or an operation as a facsimile machine or printer to perform emergent copy. Reference numeral 408 denotes a secret identification key for managing the number of copied sheets for each individual or division. Reference numeral 409 denotes a soft switch for turning the power of the image forming apparatus main body ON/OFF. Reference numeral 410 denotes a function key which is used when the function of the image forming apparatus is changed. Reference numeral 411 denotes a user mode key for entering into a user mode in which a user sets an item in advance such as ON/OFF of an automatic cassette change or a change of set time until entrance into an energy saving mode.

Reference numerals 450 to 452 denote recording material type setting keys (recording material type setting means for setting the type of recording material on which an image is formed), which are keys for setting a transparency film for an overhead projector (hereinafter referred to as OHP sheet), a thick sheet and a coated sheet. In this embodiment, the thick sheet is a recording material having a basic weight of 210 g or greater. Reference numeral 453 denotes a key for performing double side print.

(3) Fixing Apparatus 40

Figure 3:
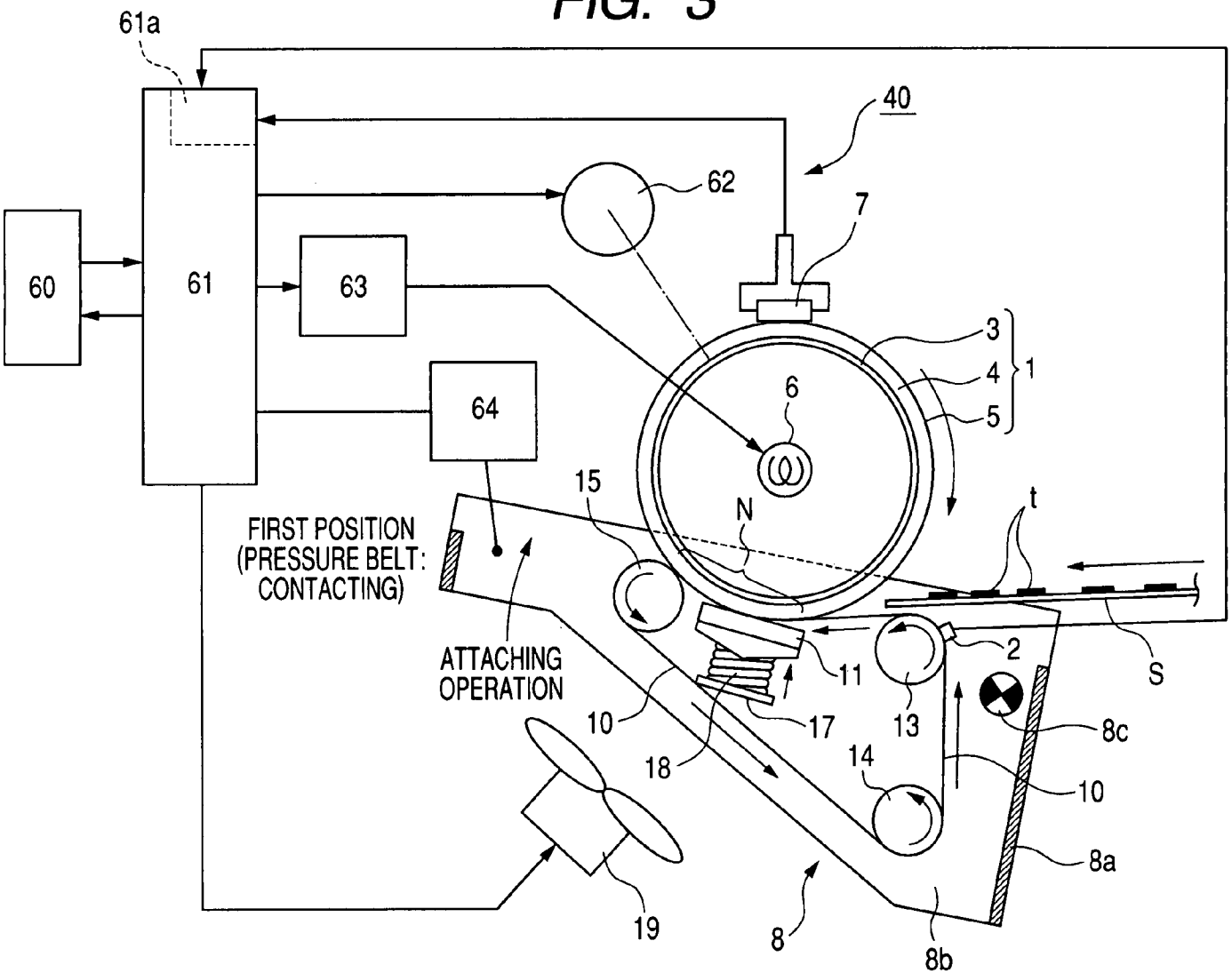
FIG. 3 is a model diagram of the general configuration of a fixing apparatus (pressure belt:contacting) and a block diagram of a control system.

FIG. 3 is a model diagram of the general configuration of the fixing apparatus 40 and a block diagram of a control system. The fixing apparatus 40 is a belt type hot-press fixing apparatus.

Reference numeral 1 denotes a fixing roller as a heating member (fixing rotating member) having a heating source arranged therein. The fixing roller 1 has a hollow core bar 3 covered with an elastic layer 4 such as a silicon rubber, and its surface is covered with a fluorine coated layer 5 as a release layer. A halogen lamp 6 being a heating source is placed in the fixing roller 1. The fixing roller 1 has its both end portions so situated as to be rotatably supported between side plates (not shown) on the rearward and frontward sides of the fixing apparatus via a bearing member. Reference numeral 7 denotes a first thermister as means for sensing the temperature of the surface of the fixing roller, which is so situated as to contact a portion of the surface of the fixing roller corresponding to a central portion of a sheet passage area.

Reference numeral 8 denotes a belt unit situated below the fixing roller 1.

The belt unit 8 has a unit frame member 8*a*, three rollers 13, 14 and 15 as belt stretching members so situated as to be bearing-wise supported rotatably in parallel with each other between side plates 8*b* on the rearward and front ward sides of the unit frame member 8*a* (side plate on the frontward side is not shown), and an endless pressure belt 10 looped over the three rollers 13, 14 and 15. Further, the belt unit 8 is an assembly having integrally a pressure pad member 11 situated inside the pressure belt 10, and a second thermister 2 as detecting means for detecting the temperature of the surface of the pressure belt 10.

The side plates 8*b* on the rearward and frontward sides of the unit frame member 8*a* are pivotally supported on the side plates on the rearward and frontward sides of the fixing apparatus, respectively, whereby the belt unit 8 is so situated as to be supported vertically rockably around a pivot portion 8*c* with respect to the fixing roller 1 with the belt unit 8 placed between the side plates on the rearward and frontward sides of the fixing apparatus.

The pressure belt 10 is a heat-resistant resin material such as polyimide shaped into an endless belt.

In the three rollers 13, 14 and 15 described above, the roller 13 is a roller on the recording material entrance side, the roller 14 is a tension roller tensioning the pressure belt 10, and the roller 15 is a recording material separating roller. A heater is placed in the interior of the roller 13 on the recording material entrance side, and passage of a current into the heater is controlled so that the belt 10 is kept at a predetermined temperature.

The second thermister 2 is so situated as to contact the surface portion of the pressure belt 10 in a portion of the roller 13 on the recording material entrance side where the belt wraps around, and a central portion in the width direction of the pressure belt 10 where the recording material is placed regardless of the size in the width direction of the recording material.

The pressure pad member 11 is aluminum shaped into a block, and is abutted against the inner surface of a portion of the pressure belt between the roller 13 on the recording material entrance side and the separating roller 15 by a lifting spring 18 provided between the backward side of the unit frame member 8*a* and a spring seat 17 provided on the side plate 8*b* on the frontward side.

Figure 4:
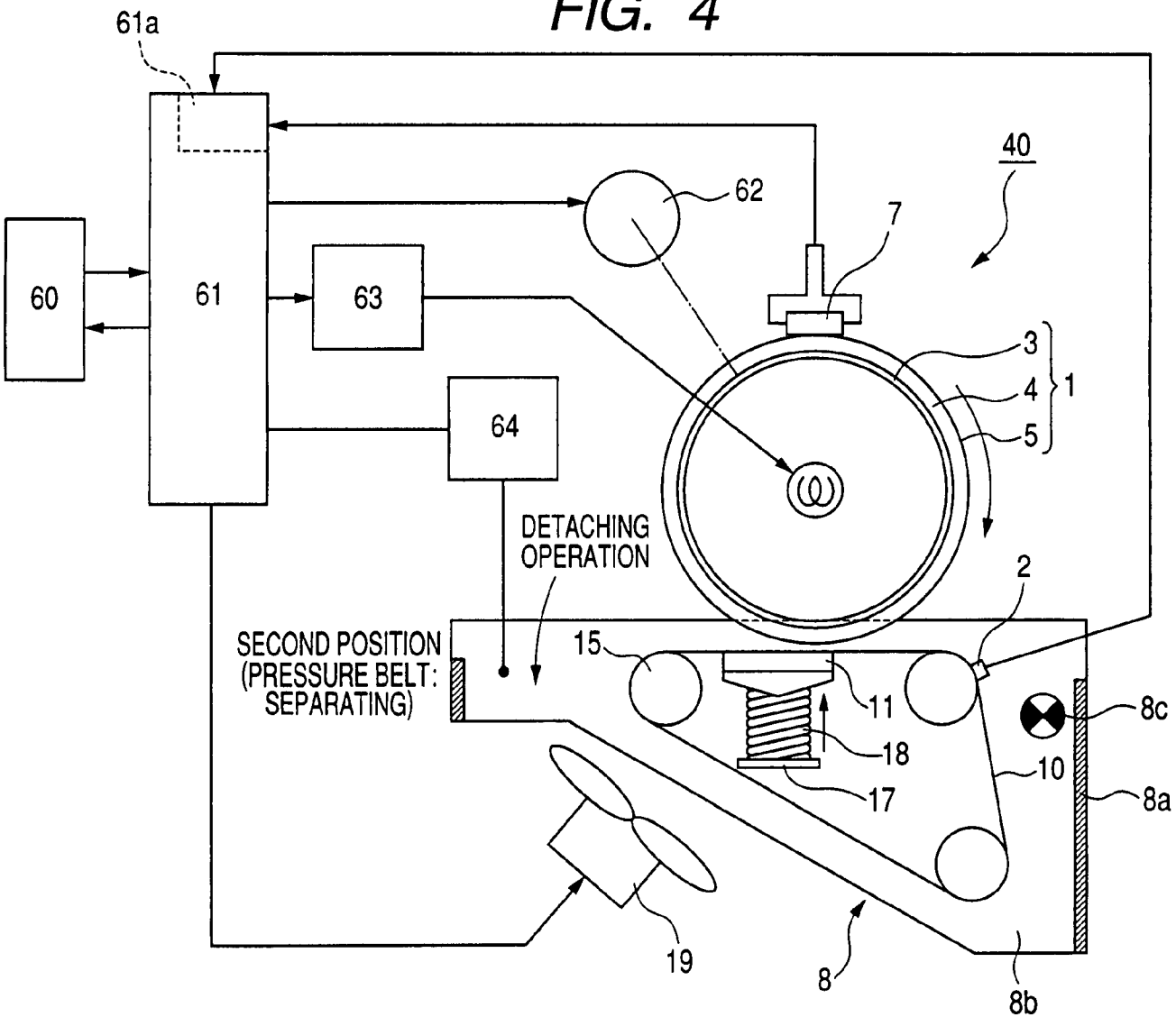
FIG. 4 is a model diagram of the general configuration of a fixing apparatus (pressure belt:separating) and a block diagram of a control system.

The reference numeral 64 denotes a vertically rocking mechanism as contacting and separating means of the belt unit 8 (means for making and breaking contact of the fixing roller 1 with the pressure belt 10), and can be comprised of, for example, an electromagnetic solenoid-plunger mechanism, cam mechanism, lever mechanism or the like. The vertical rocking mechanism 64 vertically rocks the belt unit 8 around the pivot portion 8*c* with respect to the fixing roller 1 under control by a control circuit portion (controlling means) 61. That is, switching is kept between:

1) a first position in which as shown in FIG. 3, the belt unit 8 is rotated in a lifting direction with respect to the fixing roller 1 to abut the separating roller 15 against the fixing roller 1 with the pressure belt 10 nipped therebetween, and the outer surface of a portion of the pressure belt between the separating roller 15 and the roller 13 on the recording material entrance side is made to contact the undersurface of the fixing roller 1 (attaching operation), and 2) a second position in which as shown in FIG. 4, the belt unit 8 is rotated in a lowering direction with respect to the fixing roller 1 to space the separating roller 15 and the pressure belt 10 from the undersurface of the fixing roller 1 (detaching operation).

The belt unit 8 vertically rockably around the pivot portion 8*c* with respect to the fixing roller 1 and the vertically rocking mechanism 64 of the belt unit 8 constitute a contacting and separating mechanism making the pressure belt 10 contact and be separated from the fixing roller 1.

In a state in which the belt unit 8 is in the first position as in FIG. 3, the separating roller 15 is abutted against the fixing roller 1 with the pressure belt 10 nipped therebetween, the outer surface of a portion of the pressure belt between the roller 13 on the recording material entrance side and the separating roller 15 contacts the undersurface of the fixing roller 1, and thus the belt pressure pad member 11 abuts the portion of the pressure belt against the undersurface of the fixing roller 1 with a compression reactive force of the spring 18, whereby a wide fixing nip portion N is formed between the fixing roller 1 and the pressure belt 10.

Fixing of an unfixed toner image t on the sheet S is carried out in the state in which the belt unit 8 is switched to the first position so that the fixing nip portion N is formed between the fixing roller 1 and the pressure belt 10.

That is, the fixing roller 1 is rotationally driven at a predetermined speed in the clockwise direction shown by the arrow by a driving apparatus 62 controlled by the control circuit portion 61. The pressure belt 10 dependently rotates in the counterclockwise direction shown by the arrow as the fixing roller 1 is rotationally driven. Power is supplied from a power supply portion 63 to the halogen lamp 6 being a heating source of the fixing roller 1, and the fixing roller 1 is heated with radiation heat from the halogen lamp 6. At this time, the surface temperature of the fixing roller 1 is sensed by the thermister 7, and the sensed temperature is input to a temperature adjustment circuit portion 61*a* of the control circuit portion 61 as an electric signal. The temperature adjustment circuit portion 61*a* adjusts the temperature of the surface of the fixing roller 1 by controlling the power supply from the power supply portion 63 to the halogen lamp 6 so that an electric signal corresponding to the temperature of the fixing roller input from the thermister 7 is kept to be an electric signal corresponding to a predetermined temperature.

In the state in which the fixing roller 1 is rotationally driven, the pressure belt 10 dependently rotates, and the fixing roller 1 is heated by the halogen lamp 6 and thermally adjusted to have a predetermined fixing temperature, the sheet S bearing an unfixed toner image is introduced from the roller 13 on the recording material entrance side of the belt unit 8 to the fixing nip portion N, and nipped in conveyed in the fixing nip portion N. In this process of nipping and conveying the sheet S, the surface of the unfixed toner image on the sheet S is brought into intimate contact with the surface of the fixing roller 1, and the toner image is heated with heat from the fixing roller 1 and hot pressfixed on the surface of the sheet S. The sheet S is separated from the surface of the fixing roller 1 by invading (ingression) of the separating roller into the elastic layer 4 of the fixing roller 1 at a sheet exit portion of the fixing nip portion N, and then discharged and conveyed.

The surface temperature of the pressure belt 10 is sensed by the second thermister 2, and the sensed temperature is input to a temperature adjustment circuit portion 61*a* of the control circuit portion 61 as an electric signal.

(4) Fixing Control

Fixing control with the temperature of the pressure belt 10 which characterizes the present invention will be described using FIGS. 5 to 7. The fixing control described below is executed by the control circuit portion 61 as control means.

Figure 5:
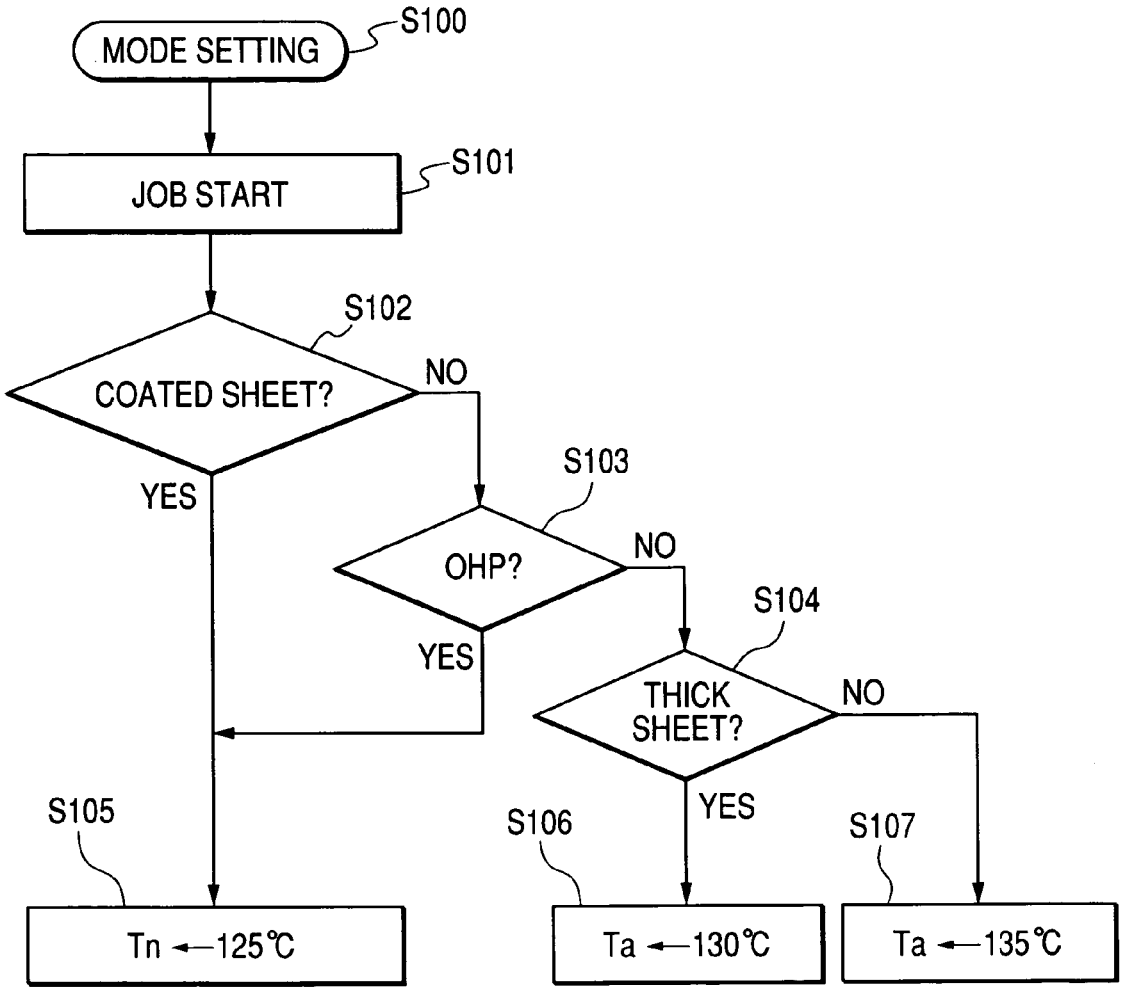
FIG. 5 is a sheet type setting flowchart.

1) The flowchart of FIG. 5 is a flowchart for determining a predetermined temperature Ta as a base of fixing control according to the type of sheet for use in the job.

At step S100, the type of sheet for use in the job (image formation process) is set with one of an OHP sheet selection key 450, a thick sheet selection key 451 and a coated sheet key 452 which are recording material type setting keys on the operation panel 60. At step S101, a copy start key 400 is pressed to start a job. First, at step S102, whether a coated sheet is set is determined. If the coated sheet is not set, processing proceeds to step S103. If the coated sheet is set, the predetermined temperature Ta as a base of fixing control is determined to be 125° C. at step S105. At step S103, whether an OHP sheet is set is determined. If the OHP sheet is not set, processing proceeds to step S104, and if the OHP sheet is set, the predetermined temperature Ta is determined to be 125° C. at step S105. At step S104, whether a thick sheet is set is determined. If the thick sheet is not set, it is determined that the type of sheet used is a normal or thin sheet, and processing proceeds to step S107, where the predetermined temperature Ta is determined to be 135° C. If the thick sheet is set, the predetermined temperature Ta is determined to be 135° C. at step S106. When the predetermined temperature Ta is set, processing proceeds to step S400 for each case.

The predetermined temperature Ta for each type of sheet is a temperature elevation allowable upper limit temperature at which no image defect/conveyance defect occurs for the pressure belt 10 in the job using the type of sheet. In relation ship with an adjusted temperature of the fixing roller, i.e. a fixing temperature Tn, the predetermined temperature Ta is set to a temperature lower than the fixing temperature Tn.

As a specific example, set fixing temperatures Tn in jobs using respective types of sheets. The predetermined temperature Ta is not changed between the normal sheet and the thin sheet. The fixing temperature Tn is not changed for each sheet in this example.

| | Coated sheet/ OHP sheet | Thick sheet | Normal sheet | Thin sheet |
|---|---|---|---|---|
| Fixing temperature Tn | 160° C. | 160° C. | 160° C. | 160° C. |
| Predetermined temperature Ta | 125° C. | 130° C. | 135° C. | 135° C. |

Figure 6:
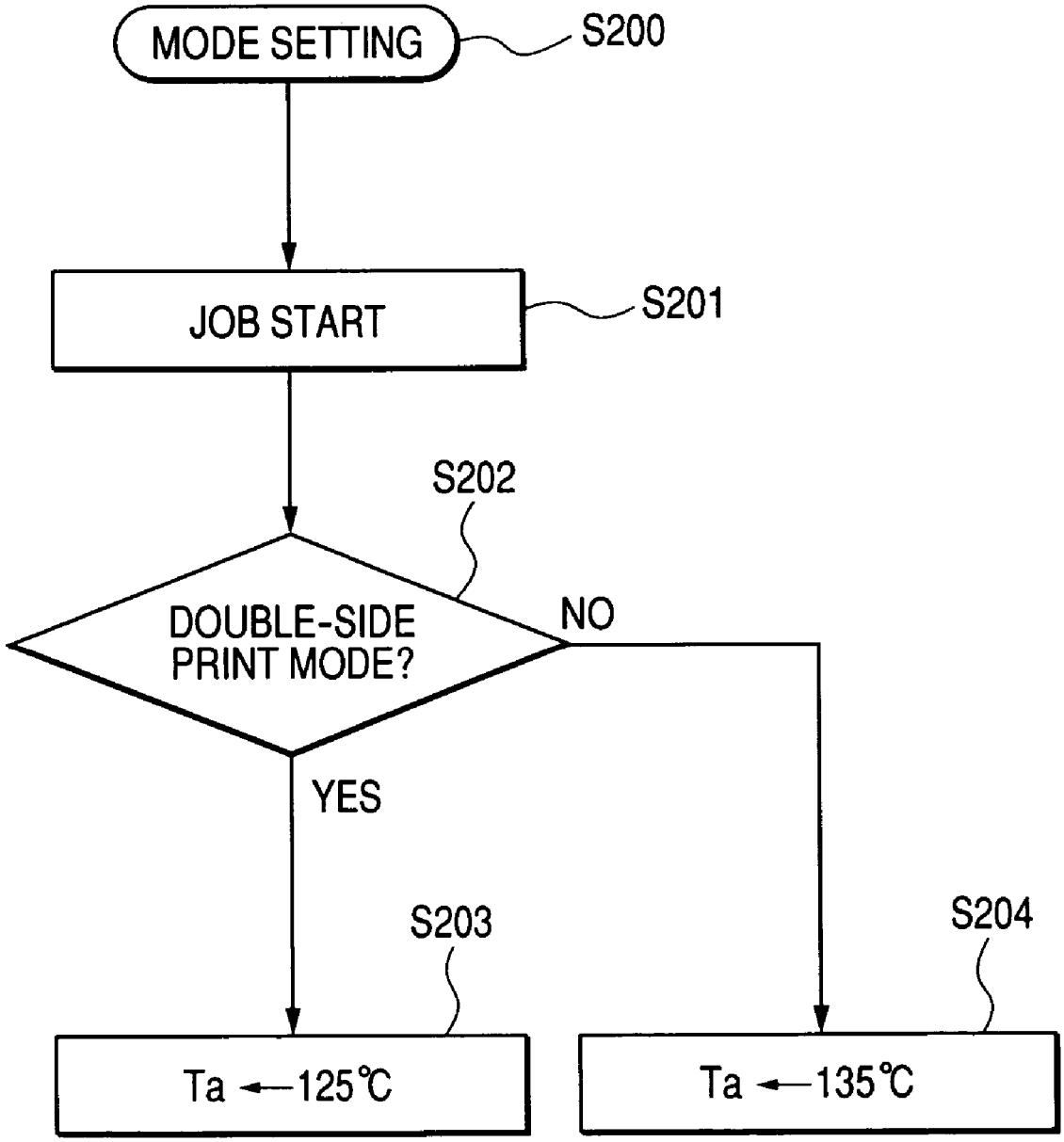
FIG. 6 is a print operation mode setting flowchart.
Figure 7:
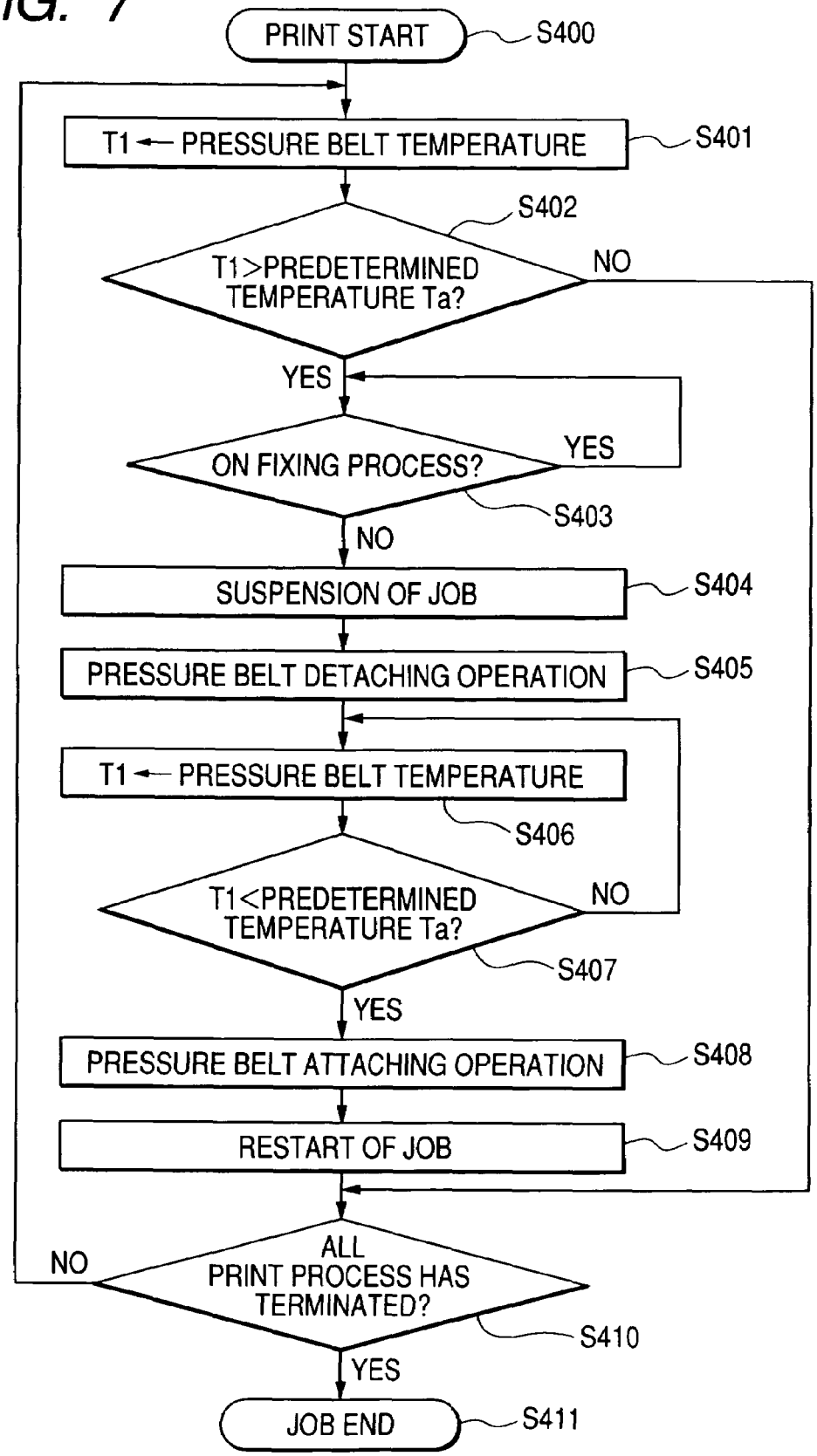
FIG. 7 is a flowchart of pressure belt detaching/attaching control in a job.

2) The flowchart of FIG. 6 is a flowchart for determining the predetermined temperature Ta as a base of fixing control according to a print operation mode.

The print operation mode of the job is set by a key 453 at step S200. At step S201, the copy start key is pressed to start the job. Whether a double side print mode is set is determined at step S202. If the double side print mode is not set, processing proceeds to step S204, where the predetermined temperature Ta is determined to be 135° C. If the double side print mode is set, the predetermined temperature Ta is determined to be 125° C. at step S203. When the predetermined temperature Ta is determined, processing proceeds to step S400 for each case.

In the above description, the predetermined temperature where the double side print mode is set, i.e. 135° C. is a temperature where the recording material used is the normal sheet (or thin sheet). If the coated sheet/OHP or thick sheet is designated, the predetermined temperature is set to 125° C. or 135° C., respectively.

The predetermined temperature Ta determined if the double side print mode is set, i.e. 125° C. is a temperature where the recording material used is the normal sheet (or thin sheet).

The predetermined temperature during formation of an image on a first surface of the recording material is identical to the predetermined temperature Ta during formation of an image on a second surface, i.e. 125° C. In this example, in terms of control, the predetermined temperature Ta is not changed according to whether a sheet to be fixed is the front surface or rear surface of double side print.

The predetermined temperature Ta for "double side print+ coated sheet or thick sheet" is identical to the predetermined temperature Ta for single side print in this embodiment. The flowchart during double side print shows that the predetermined temperature Ta is changed not only according to the type of sheet but also during double side print.

The reason why the predetermined temperature Ta is differently determined to be "135° C." where "the double side print mode is set" and "125° C." where "the double side print is not set" is basically because the temperature is different depending on existence or nonexistence of a toner on the rear surface.

If the rear surface is fixed during double side print, a fixed toner already exists on the rear side (front surface) of the sheet. In this case, if the predetermined temperature Ta is too high, the toner already fixed on the rear side is remelted. The problem arising from the remelting is basically the increased possibility that the remelted toner is stuck to the belt and thus the sheet is not released, depending on the material of the belt. Of course, an image defect may occur. For avoiding such a situation, a difference is provided in the predetermined temperature Ta between single side print and double side print.

The type of sheet and the print operation mode in this embodiment are intended for determination of the value of the predetermined temperature Ta as a base of fixing control, and do not limit the scope of the present invention.

3) detaching/attaching control of the pressure belt 10 during the job according to the temperature of the pressure belt 10 will be described using the flowchart of FIG. 7.

At step S400, the print operation is started. A temperature T1 of the pressure belt 10 is read from a second thermister 8. At step S402, the value of the temperature T1 of the pressure belt is compared with the predetermined temperature Ta as a base of fixing control as determined at steps S200 to S207. If the temperature T1 of the pressure belt is lower than the predetermined temperature Ta, processing proceeds to step S409, and if the temperature T1 of the pressure belt is higher than the predetermined temperature Ta, processing proceeds to S403. At step S403, it is determined that fixing process is currently executed, and when the fixing process is ended, processing proceeds to step S404. At step S404, the job is temporarily interrupted, and the detaching operation of the pressure belt 10 is executed. The pressure belt 10 after the detaching operation is controlled so that it is successively rotated, and the amount of current passed through the heater in the roller 13 on the recording material entrance side is also controlled (e.g. passage of currents is off). At this time, time of interruption of the image formation job is shortened as much as possible, and therefore cooling means such as a fan 19 for actively cooling the pressure belt 10 is preferably provided.

At step S406, the temperature T1 of the pressure belt 10 is read from the second thermister 8 again. If the temperature T1 of the pressure belt is higher than the predetermined temperature Ta at step S407, processing returns to step S406, where processing waits until the temperature T1 of the pressure belt becomes lower than the predetermined temperature difference Ta. When the temperature T1 of the pressure belt becomes lower than the predetermined temperature Ta, the attaching operation of the pressure belt 10 is executed at step S408, and the job is restarted at step S409. At step S410, whether all print process is ended is determined, and if all print process is not ended, processing returns to step S401, and if it is ended, process is ended at step S411.

As described above, the detaching operation of the pressure belt 10 is executed even when the image formation job for continuously forming images on a plurality of recording materials is in progress, whereby the pressure belt 10 can be kept at a temperature at which no image defect and conveyance defect occurs. That is, a difference in temperature between the fixing roller 1 and the pressure belt 10 can be kept at a temperature equal to or higher than a predetermined temperature.

(5) Others

1) The heating means of the fixing roller as a rotating member in belt fixing is not limited to an inside heating system as in the embodiment, but may be an outside heating system, or a combination of the inside and outside heating systems. Furthermore, the fixing roller itself may be made to generate heat by an electromagnetic induction heating system.

2) The detaching/attaching mechanism making the pressure belt 10 contact and be separated from the fixing roller 1 is not limited to the configuration of the embodiment, but may be arbitrarily configured.

3) The belt heating means is not limited to the fan 19, but may be, for example, a heat dissipating fin, heat pipe or the like contacting the belt to remove heat.

4) The image forming means for forming an unfixed toner image on the recording material may be of various kinds of image formation principles/processes such as electrophotography, electrostatic recording and magnetic recording, and is not limited to a transferring system, but may be a system in which unfixed toner image is formed and borne on the recording material in a direct manner. It may be color or multiple color image forming means as a matter of course.

5) In the embodiment described above, the sheet type of recording material to be passed is manually set with recording material sheet type setting means 450 to 452 (if the sheet type is not set with the means, it is set to the normal or thin sheet), but sheet type automatically sensing means for automatically sensing the sheet type of recording material passed may be provided to automatically set the sheet type.

6) In the embodiment described above, the fixing apparatus fixing an unfixed toner image formed on the recording material has been described as an example, but the present invention may be applied when the apparatus is used as an image heating apparatus having a configuration in which an unfixed toner image formed on the recording material is temporarily fixed, a configuration in which a toner image temporarily fixed on the recording material is reheated, or the like.

In conclusion of the above embodiment, during the image formation job (during image formation process), the temperature of the belt is detected, and the detected temperature T1 of the belt is compared with the predetermined temperature Ta as a belt temperature elevation allowable upper limit temperature, whereby the job is continued when T1<Ta is met, and the separating operation of the belt is executed when T1≧Ta is met. The temperature of the belt is elevated by separating the belt, and the job is restarted at the time when the temperature decreases to the extent that T1<Ta is met. In this way, the image formation process is temporarily interrupted while the temperature of the belt is equal to or higher than the predetermined temperature, whereby occurrence of an image defect such as a blister and a recording material conveyance defect resulting from elevation of the temperature of the belt to a level exceeding an allowable temperature, and an image defect resulting from the recording material conveyance defect can be prevented even when the job for continuously forming images on a plurality of recording materials is in progress. Thus, satisfactory fixing process can be constantly carried out from the initial stage to the late stage of the image formation job, thus making it possible to prevent a situation in which an image defect occurs when the job is in progress, resulting in a degradation in image quality.

Print operation mode setting means for setting a print operation mode is provided, and control means determines a predetermined temperature according to a mode set by the print operation mode setting means, whereby, for example, occurrence of an under-winding jam during the double side print mode can be prevented, thus making it possible to achieve speed enhancement.

This application claims priority from Japanese Patent Application No. 2004-105244 filed Mar. 31, 2004, which is hereby incorporated by reference herein.

What is claimed is:

1. An image forming apparatus comprising:

an image forming device which forms a toner image on a recording material during an image formation job;

a heating member which heats the toner image formed on the recording material by said image forming device at a nip portion;

an endless belt which forms said nip portion with said heating member;

a separating device which separates said heating member and said belt from each other;

a detector which detects a temperature of said belt; and a controller which controls said separating device to separate said heating member and said belt from each other when the temperature detected by said detector reaches a predetermined temperature, wherein the predetermined temperature corresponds to a type of recording material used in the image formation job and the predetermined temperature corresponding to a resin coated paper is lower than the predetermined temperature corresponding to a plain paper.

2. The apparatus according to claim 1, wherein when, after said separating device separates said heating member and said belt, the temperature decreases to a temperature lower than the predetermined temperature, said controller brings said heating member and said belt into contact with each other and restarts the image formation job.

3. The apparatus according to claim 2, further comprising a cooling device which cools said belt when said heating member and said belt are separated.

4. The apparatus according to claim 2, wherein said separating device separates said belt from said heating member by movement of said belt.

5. An image forming apparatus comprising:

an image forming device which forms a toner image on a recording material;

a fixing member which fixes the toner image onto the recording material at a nip portion, wherein said fixing member is heated by a heater so as to maintain a fixing temperature;

an endless belt which forms the nip portion with said heating member;

a detector which detects a temperature of said belt;

a separating device which interrupts by separating an image formation job for plural recording materials and separates said heating member and said belt from each other when the temperature detected by said detector reaches a separating temperature during the image formation job; and a controller which changes a difference between the fixing temperature and the separating temperature in accordance with a type of the recording material.

6. The apparatus according to claim 5, wherein the difference for a resin coated paper is larger than the difference for a plain paper.

7. The apparatus according to claim 5, wherein when the temperature detected by said detector decreases to a temperature lower than the separating temperature during separation of said heating member and said belt, said controller brings said heating member and said belt intro contact each other and restarts the image formation job.

8. The apparatus according to claim 5, further comprising a cooling device which cools said belt when said heating member and said belt are separated.

9. The apparatus according to claim 5, wherein said separating device separates said belt from said heating member by movement of said belt.

* * * * *

UNITED STATES PATENT AND TRADEMARK OFFICE

CERTIFICATE OF CORRECTION

PATENT NO. : 7,280,777 B2
APPLICATION NO. : 11/085549
DATED : October 9, 2007
INVENTOR(S) : Keita Takahashi et al.

It is certified that error appears in the above-identified patent and that said Letters Patent is hereby corrected as shown below:

ON THE TITLE PAGE:
At Item (56), References Cited, Foreign Patent Documents, "01195483 A" should read --01-195483 A--.

COLUMN 1:
Line 23, "so called a" should read --a so called--.
Line 39, "i.e." should read --i.e.,--.

COLUMN 4:
Line 51, "he" should read --the--.

COLUMN 6:
Line 9, "thermister" should read --thermistor--.
Line 19, "front ward" should read --frontward--.
Line 24, "thermister" should read --thermistor--.
Line 45, "thermister" should read --thermistor--.

COLUMN 7:
Line 46, "thermister" should read --thermistor--.
Line 53, "thermister" should read --thermistor--.

COLUMN 8:
Line 7, "thermister" should read --thermistor--.
Line 43, "relation" should read --relationship--.
Line 44, "ship" should be deleted.

COLUMN 9:
Line 56, "thermister" should read --thermistor--.

COLUMN 10:
Line 11, "thermister" should read --thermistor--.

UNITED STATES PATENT AND TRADEMARK OFFICE

CERTIFICATE OF CORRECTION

PATENT NO. : 7,280,777 B2
APPLICATION NO. : 11/085549
DATED : October 9, 2007
INVENTOR(S) : Keita Takahashi et al.

It is certified that error appears in the above-identified patent and that said Letters Patent is hereby corrected as shown below:

COLUMN 12:
Line 45, "intro contact" should read --into contact with--.

Signed and Sealed this

Thirteenth Day of May, 2008

JON W. DUDAS
*Director of the United States Patent and Trademark Office*